US006196894B1

(12) United States Patent
Kennedy et al.

(10) Patent No.: US 6,196,894 B1
(45) Date of Patent: Mar. 6, 2001

(54) VEHICLE WITH SPRING MOTOR OPERABLE IN RUNNING AND REWIND MODES

(76) Inventors: Melvin R. Kennedy, 825 Marbella La., Lantana, FL (US) 33462; Dietmar Nagel, 11 South Rd., Chester, NJ (US) 07930-2739

( * ) Notice: Subject to any disclaimer, the term of this patent is extended or adjusted under 35 U.S.C. 154(b) by 0 days.

(21) Appl. No.: 09/312,176

(22) Filed: May 14, 1999

(51) Int. Cl.[7] ..... A63H 29/24; A63H 29/00; F03G 1/00

(52) U.S. Cl. ..... 446/461; 446/457; 446/464; 185/DIG. 1; 185/40 H

(58) Field of Search ..... 446/457, 461, 446/463, 464, 425; 185/40 H, 38, DIG. 1

(56) References Cited

U.S. PATENT DOCUMENTS

| | | | | |
|---|---|---|---|---|
| 3,932,956 | * | 1/1976 | Young | 446/463 |
| 4,116,084 | * | 9/1978 | Masuda | 446/463 X |
| 4,135,329 | | 1/1979 | Kennedy . | |
| 4,332,104 | * | 6/1982 | Ribas et al. | 446/457 |
| 4,478,313 | * | 10/1984 | Wakase | 185/DIG. 1 |
| 4,563,164 | * | 1/1986 | Tao | 446/463 X |
| 4,582,171 | * | 4/1986 | Jezierski | 446/463 X |
| 4,648,487 | * | 3/1987 | Kimura | 446/464 X |
| 4,683,986 | | 8/1987 | Darda et al. . | |
| 4,842,567 | * | 6/1989 | Hiraide | 446/464 |
| 5,103,936 | * | 4/1992 | Morikawa | 446/464 X |
| 5,176,223 | * | 1/1993 | Ito | 446/464 X |
| 5,188,198 | * | 2/1993 | Muramatsu et al. | 446/464 X |
| 5,638,922 | * | 6/1997 | Morikawa | 446/464 X |

* cited by examiner

*Primary Examiner*—D. Neal Muir
(74) *Attorney, Agent, or Firm*—Cohen, Pontani, Lieberman & Pavane

(57) ABSTRACT

The disclosure describes a spring motor, in combination with a toy vehicle, that easily can be manufactured and wound up by moving the vehicle in reciprocating forward and backward movements. The motor is operable in rewind and run modes, and includes first and second spring gears; a spring having a first end yieldably engaged to the first spring gear and a second end connected to the second spring gear; a rear wheel axle having first and second drive pinions thereon, wherein the first drive pinion is meshed with the first spring gear; a rewind gear which is meshed with the second drive pinion of the rear wheel axle; a fixed gear that is meshed with the rewind gear; and a floating gear which is meshed with the fixed gear, wherein during the rewind mode the floating gear is meshed with the second spring gear, but during the run mode is disengaged from the second spring gear. A retaining lock is used to maintain the meshing of the second spring gear with the floating gear to prevent unwinding of the spring. Disengagement takes place when the vehicle is pushed in the forward direction thus causing the spring to unwind and drive the vehicle forward.

9 Claims, 4 Drawing Sheets

12a
80
71
82

72
73
64a
74
75
64
60
12a
71
70
76
64b 3e
82
71
66
26
64
58
76
46
70
12a
3c
32
48
75
12b
38
24
50
44
3e
3c 12b
3b
3f
3f
3b 80
84

50
12a
54
52

82
71
73
72
70
75

VEHICLE WITH SPRING MOTOR OPERABLE IN RUNNING AND REWIND MODES

BACKGROUND OF THE INVENTION

1. Field of the Invention

The present invention relates generally to spring motors and particularly to spring motors which are adaptable for use in toys such as toy vehicles.

2. Description of the Related Art

U.S. Pat. No. 4,135,329 issued to Kennedy on Jan. 23, 1979 ("the '329 patent") describes a spring motor that is relatively easily and inexpensively manufactured, and that efficiently delivers a high portion of the energy stored in its spring to the ultimate drive and which is easily and efficiently rewound by a child. The '329 patent eliminated the disadvantageous characteristics of the then prior art motors and comprised a device that has characteristics that various prior art constructions sought to achieve. Essentially the '329 patent disclosed a spring motor for use as an example in a miniature toy vehicle that can be conveniently and reasonably wound up by a reciprocating front and back movement of the vehicle, wherein the backward movement produced substantially more winding up than an unwinding of the spring. The '329 patent disclosed a spring motor that avoided complicated and sophisticated structures in order to produce rewinding of the spring on a backward movement of the car.

U.S. Pat. No. 4,683,986 issued to Darda et al. on Aug. 4, 1987 ("the '986 patent") discloses a spring drive mechanism having a spiral spring positioned in a spring encasement as a power source. One end of the spring is connected to a spring encasement gear and the other end to a spring shaft gear. For winding up the spring, the spring encasement gear is in mesh with a first drive pinion and the spring shaft gear is in mesh with a second drive pinion. These drive pinions have a stress-free connection to a wind down/wind up shaft across unidirectional torque transmitters. Each of these unidirectional torque transmitters permits rotation in a direction opposite to the other. A reverse pinion has one pinion sprocket in mesh with the spring shaft gear. The other pinion sprocket is in mesh with the drive pinion in the wind up position. In this position, the spring drive mechanism is blocked in such a way that the tensioned driving spring cannot release. In order to maintain the reverse pinion in this position without any use of external force, an engaging lever is provided and is constructed in such a way that the blocking is released when the wind down/wind up shaft is turned counterclockwise.

The blocking feature of the '986 patent is a desirable feature, but the structure disclosed in said patent to accomplish the feature is relatively complicated and expensive to manufacture. There is a need for an improved spring motor that includes, inter alia, such a blocking feature without the complicated structures of the prior art. There is also a need to accomplish a faster rewind of the spring motor, again, without the complicated structures of the prior art.

SUMMARY OF THE INVENTION

The present invention is directed to spring motors, which are adaptable for use in toys such as toy vehicles and which satisfy the identified needs. The spring motor of the present invention is operable in a run mode and a rewind mode, and comprises first and second spring gears, a spring having a first end yieldably engaged to the first spring gear and its opposite end connected to the second spring gear, a rear wheel axle having first and second drive pinions thereon, wherein the first drive pinion is in mesh with the first spring gear, a rewind gear that is in mesh with the second drive pinion of the rear wheel axle, a fixed gear that is in mesh with the rewind gear, and a floating gear that is in mesh with the second spring gear. During the rewind mode of the spring motor the floating gear is in mesh with the fixed gear. However, during the run mode, the floating gear is disengaged from the fixed gear.

The spring motor is in rewind mode when the rear wheel axle is turning in a clockwise direction. This is accomplished, for example, when a toy vehicle incorporating the spring motor according to the present invention is pushed in the backward direction. During the rewind mode, the spring is tensioned from both of its ends by the two spring gears. This is accomplished by causing the floating gear to engage with the fixed gear thus causing the second spring gear and the inner end of the spring to wind in a clockwise direction. At the same time, the first spring gear causes the outer end of the spring to turn in the opposite or counterclockwise direction. Hence the rewind is accomplished at a faster rate than winding solely the outer end of the spring. The engagement of the floating gear with the fixed gear is maintained by a retainer affixed on the outside of the motor housing, the retainer comprising a detent. The engagement of the floating gear with the fixed gear is maintained by the detent until the rear wheel axle is caused to rotate in the counterclockwise direction, such as when the toy vehicle incorporating the spring motor of the present invention is pushed in the forward direction. The retainer is made of plastic.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

The above and other objects, features, and advantages of the present invention will be best understood by considering the following detailed description of the invention, appended claims, and accompanying drawings, wherein like reference characters denote similar elements throughout the several views:

DETAILED DESCRIPTION OF THE PRESENTLY PREFERRED EMBODIMENTS

General Overview

Figure 1A:
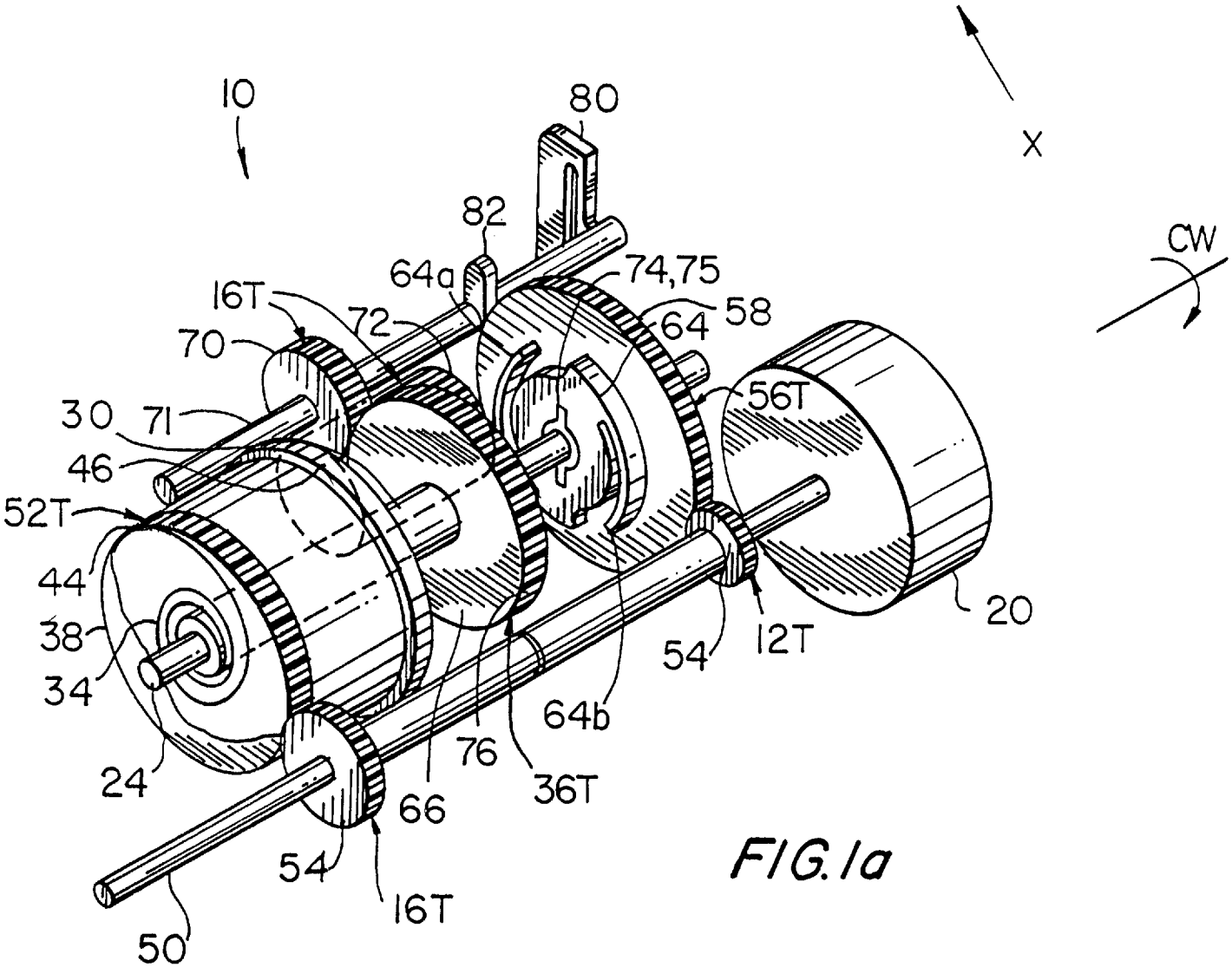
FIG. 1*a* is a perspective view from one side of a motor in accordance with the present invention.
Figure 1B:
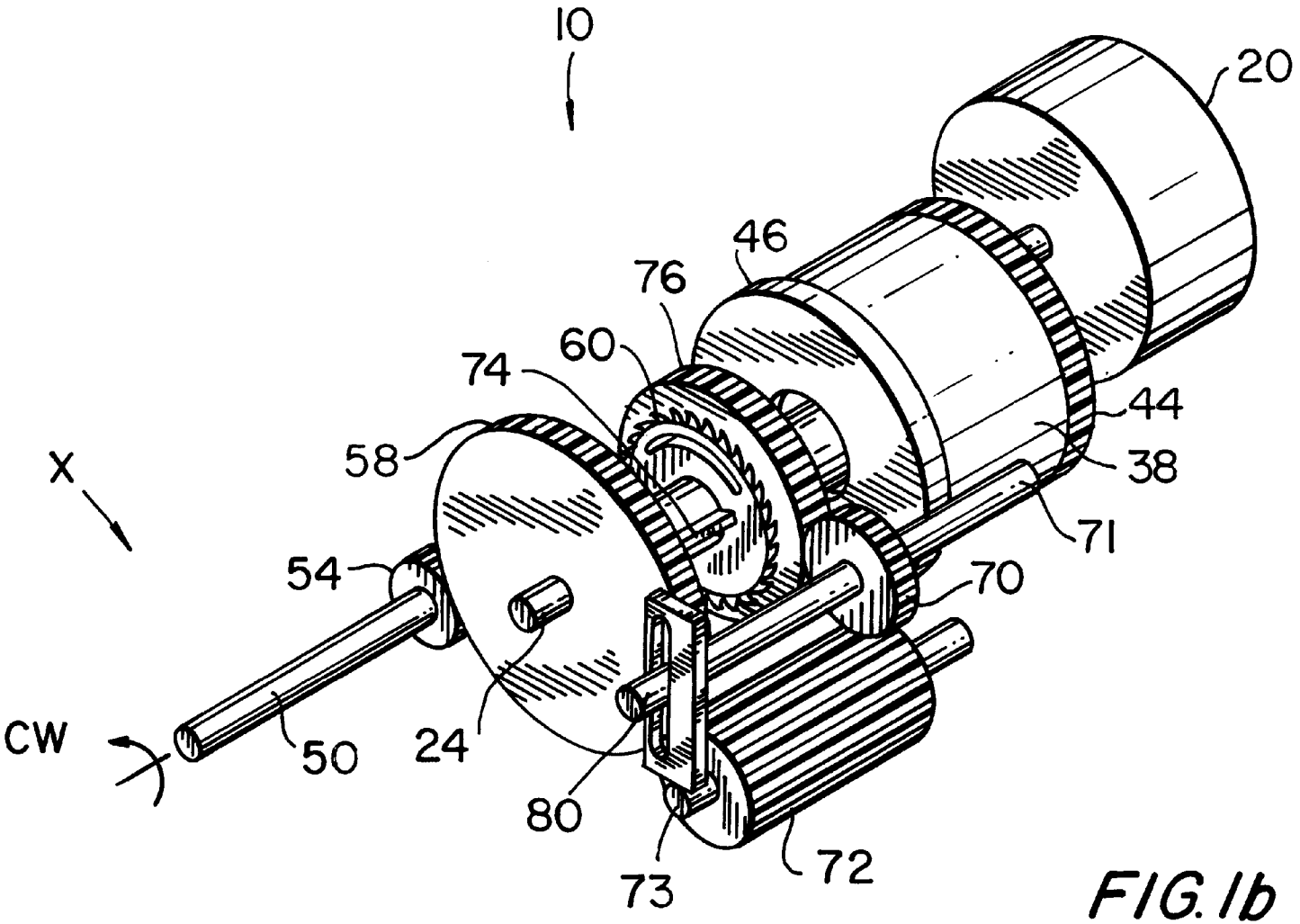
FIG. 1*b* is a perspective view from the opposite side of FIG. 1*a* of a motor in accordance with the present invention.

As a reference point, the clockwise direction is indicated by the arrow CW in FIGS. 1*a* and 1*b*. FIGS. 1*a* and 1*b* are perspective views of a motor 10 in accordance with the present invention. Motor 10, also depicted in FIGS. 3*a* to 3*g*, comprises a motor member 66, a spring drum 38, a spring 34, a floating gear 70, a fixed gear 72, a rewind gear 58, and a ratchet 64. The spring 34, as illustrated, is disposed within the spring drum 38, and comprises a first end and a second end, which is opposite to the first end. The motor member 66 further comprises a main motor shaft 30 to which the first end of the spring 34 is attached. The opposite or second end of the spring 34 is operatively engaged with the inner cylindrical surface of the spring drum 38. As subsequently described in further detail, the spring 34 preferably is a spiral spring (i.e., generated by a point moving around a fixed point while constantly receding from said fixed point), in which the first end attached to the motor shaft 30 is the inner end and the opposite end yieldably held in position against the inner surface of the spring drum 38 is the outer end. The rewind gear 58 includes a splined shaft 74. The ratchet 64 has an opening 75 into which the splined shaft 74 of the rewind gear 58 is press fitted to form a single unit. The ratchet 64 further comprises ratchet fingers 64*a* and 64*b*, which are operatively engaged with ratchet teeth 60 formed in the inner cylindrical surface of the motor member 66. The fixed gear 72 is in mesh with the rewind gear 58. The floating gear 70 is in mesh with a second spring gear 76. The main motor shaft 30, the second spring gear 76, the ratchet 64, and the rewind gear 58 are mounted to rotate freely around a spring axle 24. A rear wheel axle 50 runs parallel to the spring axle 24. To this rear wheel axle 50 is fixed a first pinion gear 52, which is in engagement with a first spring gear 44. Also fixed to the rear wheel axle 50 is a second pinion gear 54. The second pinion gear 54 is in mesh with the rewind gear 58. Rear wheels 20 are affixed to the ends of the rear wheel axle 50. When the motor 10 is in rewind mode, i.e., when the rear wheels 20 are rotating in a clockwise direction, the floating gear 70 is in mesh with the fixed gear 72. However, when the rear wheels 20 are rotating in a counterclockwise direction, the floating gear 70 disengages from the fixed gear 72.

The Rewind Mode

The motor 10 is in rewind mode when the rear wheels 20 are caused to rotate in a clockwise direction. This causes the rear wheel axle 50 also to rotate in a clockwise direction which, in turn, causes the first and second pinion gears 52, 54 likewise to rotate in a clockwise direction. The first and second pinion gears 52, 54 are always engaged with the first spring gear 44 and the rewind gear 58 respectively. Therefore when the rear wheels 20 are rotating in the clockwise direction, both the first spring gear 44 and the rewind gear 58 are caused rotate in the counterclockwise direction. Because rewind gear 58 and fixed gear 72 are always engaged with each other, the counterclockwise rotation of rewind gear 58 causes fixed gear 72 to rotate in the clockwise direction.

When the spring 34 is completely unwound, at the very instant when the motor 10 enters the rewind mode (i.e., when the rear wheels 20 are caused to rotate in a clockwise direction), the second spring gear 76 is temporarily caused to rotate in the counterclockwise direction, which is the same direction in which the first spring gear 44 is rotating. The reason for this is when the spring 34 is completely unwound, a rotation of the first spring gear 44 in the counterclockwise direction will cause the spring 34 to apply a torque on the main motor shaft 30 (to which the first end of the spring 34 is attached) to rotate in the counterclockwise direction. Thus, the second spring gear 76 likewise is momentarily caused to rotate in the counterclockwise direction, which, in turn, causes the floating gear 70, which is always in mesh with the second spring gear 76, to rotate (momentarily) in the clockwise direction. At such an instant, the second spring gear 76 is thus driving the floating gear 70.

However, when the second spring gear 76 drives the floating gear 70 to turn in the clockwise direction, the floating gear 70 is forced to move toward the fixed gear 72, and becomes enmeshed with fixed gear 72. (The operation of the floating gear 70 subsequently is explained more fully in connection with the discussion of FIGS. 3*a* to 3*g*.) Once the floating gear 70 is in mesh with the fixed gear 72, the floating gear 70 reverses the direction in which it is turning, and turns in the counterclockwise direction because the fixed gear 72 is turning in the clockwise direction. At the instant when the floating gear 70 is in mesh with the fixed gear 72, the floating gear 72 drives the second spring gear 76 to rotate in the clockwise direction.

This clockwise rotation of second spring gear 76 causes main motor shaft 30 likewise to rotate in the clockwise direction, thus causing the first (i.e., the inner) end of the spring 34 to wind in the clockwise direction. Concurrently, however, the first pinion gear 52 is rotating in the clockwise direction. Because the first pinion gear 52 is always engaged with the first spring gear 44, a clockwise rotation in the first pinion gear 52 causes the spring drum 38 to rotate in the counterclockwise direction, thereby causing the opposite (i.e., the outer) end of the spring 34 to wind in the counterclockwise direction. Thus, during the rewind mode the outer end of the spring 34 is caused to wind in the counterclockwise direction, while its inner end is caused to wind in the clockwise direction, thereby causing the spring 34 to rewind at a much faster rate than when the inner end of the spring 34 is stationary and only the outer end of the spring 34 is being wound or when the outer end of the spring 34 is stationary and only the inner end of the spring 34 is being wound.

Figure 2A:
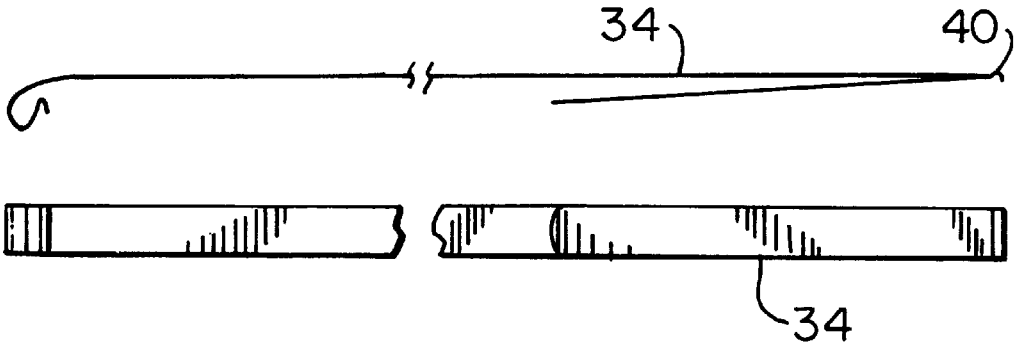
FIG. 2*a* depicts the spring of an embodiment of the present invention.
Figure 2B:
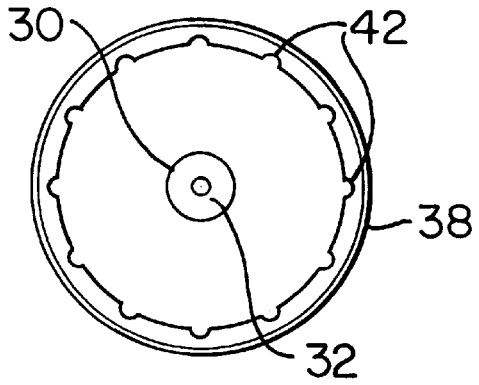
FIG. 2*b* shows the inner cylindrical surface of the spring drum of an embodiment of the present invention.
Figure 2C:
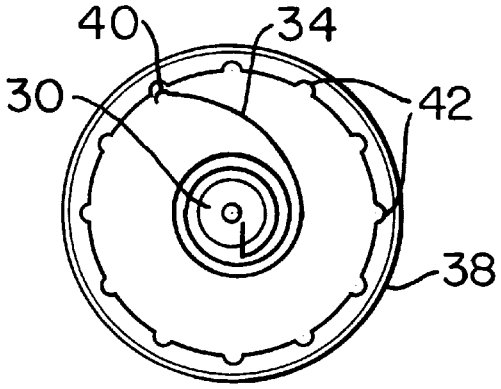
FIG. 2*c* depicts the spring inside the spring drum in an embodiment of the present invention.

Preferably, the spring 34 is of the type generally known as a clock spring. FIG. 2*a* depicts the spring 34 in its unwound state. Protrusion 40 is formed adjacent to the outer end of the spring 34 to allow cooperative engagement with the inner cylindrical surface of the spring drum 38, on which, as shown in FIG. 2*b*, depressions 42 are formed. As depicted in FIG. 2*c*, the protrusion 40 of the spring 34 is normally maintained within one of the depressions 42. However, if the spring 34 is over-wound the protrusion 40 pops out of the depressions 42 and re-engages in another one of the depressions 42 at some point at which the stress on the spring 34 does not exceed its design criteria. Hence, further attempts to rewind the spring 34 after it is fully wound produces a clicking sound, which is protrusion 40 bouncing out of one depressions 42 and into the next one. Thus the clicking sound signals the completion of the rewind mode.

The operation of floating gear 70 can be better understood with reference to FIGS. 3*a* to 3*g*. As depicted in these figures, motor 10 is enclosed within a motor housing comprising first and second housing parts 12*a* and 12*b*. The first (i.e., inner) end of the spring 34 (see FIGS. 1*a* and 3*b*) is attached into slot 32 of main motor shaft 30. The spring drum 38 is closed off as by snapping into place a retaining cap 46, which insures the axial retention of the spring 34 within the spring drum 38. Of course, other ways of closing off the inner surface of the spring drum 38 may be used without departing from the present invention. A central opening 48 is formed within the retaining cap 46 to provide clearance room for the insertion of the main motor shaft 30 therethrough.

The motor member 66 is mounted for rotation on the spring axle 24 which in turn is positioned with the bearing openings 26 formed in the first and second housing parts 12*a* and 12*b*. The motor member 66 has a bearing opening 28 formed along its central axis, and it is mounted to freely rotate around the spring axle 24. Ratchet teeth 60 are formed on the inner surface of the motor member 66. The splined shaft 74 of the rewind gear 58 is press fitted into the opening 75 of the ratchet 64, forming a single unit. The ratchet fingers 64*a* and 64*b* of the ratchet 64 are operatively engaged with the ratchet teeth 60 formed in the inner cylindrical surface of the motor member 66. During the rewind mode, the rewind gear 58 and ratchet 64 are rotating in the counterclockwise direction, while at the same time motor member 66 is rotating in the clockwise direction. This results in a lost motion because rewind gear 58 is mounted for rotation about spring axle 24 and ratchet teeth 60 slip in lost motion relative to the ratchet fingers 64*a* and 64*b* of the ratchet 64.

Figures 3A, 3B, 3C, 3D, 3E, 3F, 3G:
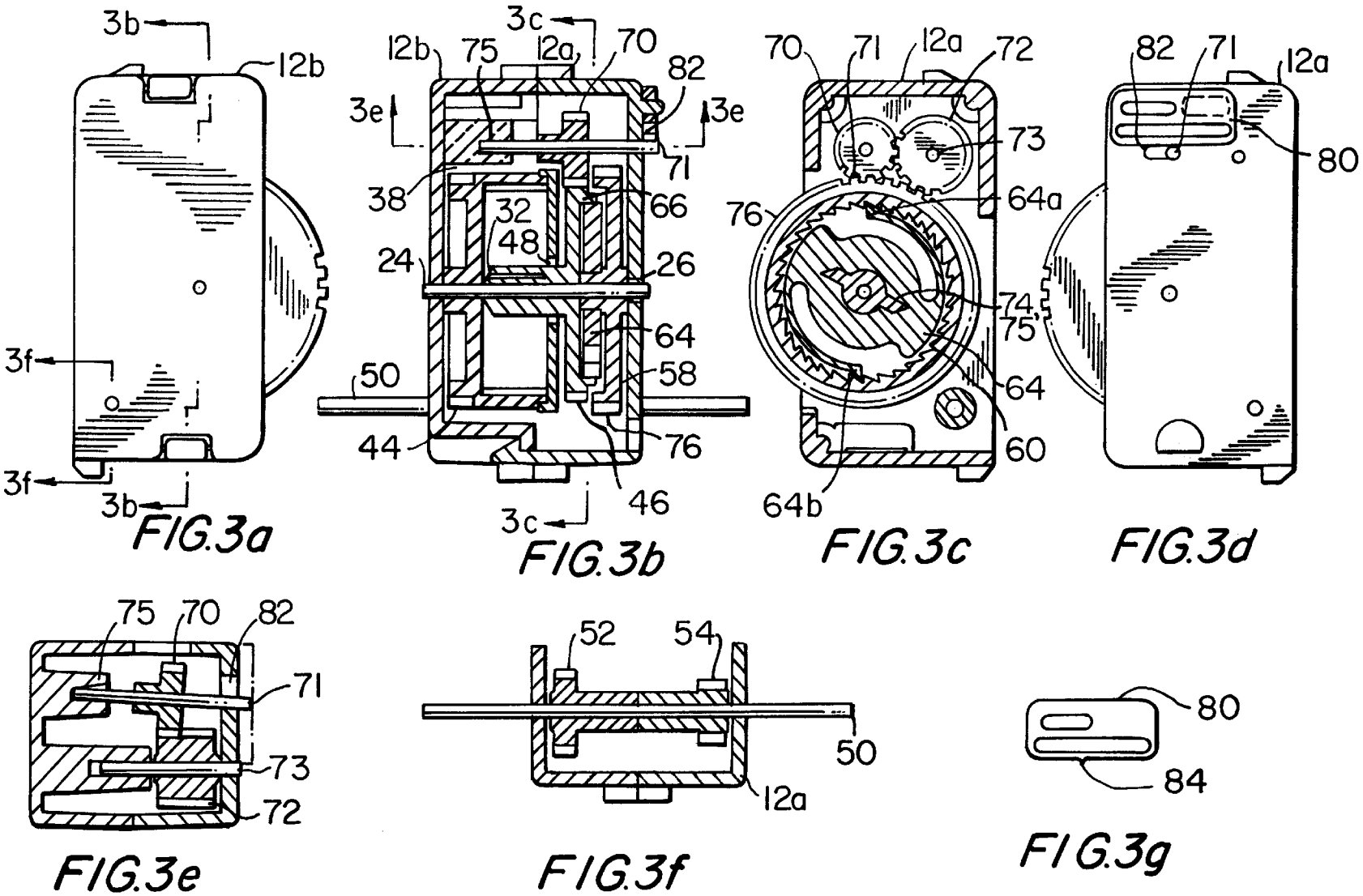
FIG. 3*a* is a side view of the housing of a motor in accordance with the present invention.
FIG. 3*b* is a cross sectional view taken along line A—A in FIG. 3*a;*
FIG. 3*c* is a cross sectional view taken along line C—C in FIG. 3*b;*
FIG. 3*d* is a side view of the housing of a motor in accordance with the present invention looking from t he opposite side from FIG. 3*a;*
FIG. 3*e* is a cross sectional view taken along line D—D in FIG. 3*b;*
FIG. 3*f* is a cross sectional view taken along line B—B in FIG. 3*a*.
FIG. 3*g* shows a retainer on a housing of a motor in accordance with the present invention.

A first end of the shaft 71 of the floating gear 70 rests in a sleeve 75 (FIGS. 3*b* and 3*e*). A second end, which is opposite to the first end, of the shaft 71 rests in a slot 82 in the first housing part 12*a*. As shown in FIG. 3*d*, the second end of the shaft 71 extends through the first housing part 12*a* on which is affixed a retainer 80. The retainer 80 is made of plastic, and has a detent 84 (FIG. 3*f*). The sleeve 75, as shown clearly in FIG. 3*e*, is tapered, and allows the second end of the shaft 71, which rests in the slot 82, at any given time to take one of two positions: a first position wherein the floating gear 70 is in mesh with the fixed gear 72 and a second position wherein the floating gear 70 is disengaged from the fixed gear 72.

As previously discussed, when the spring 34 is completely unwound, at the very instant when the motor 10 enters the rewind mode, the second spring gear 76 is temporarily caused to rotate in the counterclockwise direction, which, in turn, causes the floating gear 70 to rotate (momentarily) in the clockwise direction. Where the second spring gear 76 is physically in contact or in mesh with the floating gear 70, when the second spring gear 76 is rotating in the counterclockwise direction, the second spring gear 76 applies a force ("the engaging force") on the teeth of the floating gear 70, the engaging force generally being in the direction toward the fixed gear 72. Because the second end of the shaft 71 of the floating gear 70 is movable with respect to the first end of the shaft 71, the engaging force in the direction toward the fixed gear 72 causes the floating gear 70 to physically contact and thus become enmeshed with the fixed gear 72.

Up until this point, the second spring gear 76 may be said to be driving the floating gear 70. However, once the floating gear 70 becomes enmeshed with the fixed gear 72, the fixed gear 72 rotating in the clockwise direction during the rewind mode, the floating gear 70 begins to rotate in the counterclockwise direction and thus causes the second spring gear 76 to rotate in the clockwise direction. At such point, the floating gear 70 is driving the second spring gear 76. The clockwise rotation of the second spring gear 76, as previously described, causes the inner end of the spring 34 to wind in the clockwise direction.

FIG. 3*d* depicts a retainer 80, which is provided on the outside surface of first housing part 12*a*. In this embodiment, the retainer 80, which is also shown in FIG. 3*g*, is made of plastic and comprises a detent 84. Of course the retainer 80 may be made of other materials such as elastic metal without departing from the present invention. The detent 84 maintains the second end of the shaft 71 in one of two positions: (1) a first position on one side of the detent 84 in which the floating gear 70 is not in mesh with the fixed gear 72 and (2) a second position on another side of the detent 84 in which the floating gear 70 is in mesh with the fixed gear 72. At the very beginning of the rewind mode (or during the run mode, which is described below), the second end of the shaft 71 is in the first position. During the rewind mode, however, the engaging force applied by the spring gear 76 on the floating gear 70 overcomes the detent 84 until the second end of the shaft 71 moves to the second position.

In the second position, the tensioned spring 34 inside the spring drum 38 is blocked from unwinding. When the floating gear 70 is held in mesh with the fixed gear 72 by the detent 84, the rewind gear 58 and thus second pinion gear 54, which is in mesh with the rewind gear 58, are prevented from rotating. Accordingly, first pinion gear 52 likewise is prevented from rotating, and, because first pinion gear 52 is in mesh with the first spring gear 44, the spring 34 is likewise prevented from unwinding.

However, in this second position, as soon as the rear wheel axle 50 is turned in the counterclockwise direction, a sufficient force resulting solely from the rotation of the rear wheel axle 50 overcomes the force being applied against second end of the shaft 71 by the detent 84, and the second end of the shaft 71 of the floating gear 72 moves to the first position, thereby. causing the floating gear 70 to be disengaged from the fixed gear 72. Thus with the floating gear 70 and the fixed gear 72 so disengaged, the spring 34 inside the spring drum 38 is permitted to unwind, and the spring motor 10 enters the run mode.

The Run Mode

With the spring 34 wound, the toy car would have to be nudged in the direction of X (FIGS. 1*a* and 1*b*) to cause the wheels 20 and the rear wheel axle 50 to rotate in the counterclockwise direction, thus disengaging the floating gear 70 from the flexed gear 72, before the spring motor 10 enters the run mode. In the run mode, the outer end of the spring 34 will cause the spring drum 38 to rotate in a clockwise direction, which, in turn, will cause the first pinion gear 52 to rotate in a counterclockwise direction. This causes the rear wheel axle 50 to similarly rotate in a counterclockwise direction and also causes the rear wheels 20 to rotate in a counterclockwise direction, moving the car forward. As the rear wheels 20 drive the car in the forward direction, the second pinion gear 54, through the rotational power transmitting loop causes the main motor shaft 30 to rotate in a clockwise direction at a rotational speed slightly less than the unwinding of the spring drum 38.

Specifically, in the run mode, the second pinion gear 54 rotates in the counterclockwise direction. This, in turn, causes a clockwise rotation in the rewind gear 58. Because the fixed gear 72 is always in mesh with the rewind gear 58, the fixed gear 72 rotates in the counterclockwise direction during the run mode. This likewise causes the floating gear 70 to shift away from the motor member 66. Moreover, a clockwise rotation for the rewind gear 58 also causes the ratchet 64 to rotate in the clockwise direction. As can be seen best in FIG. 3*c*, because of the arrangement of the ratchet teeth 60 and the ratchet fingers 64*a* and 64*b*, the rotation of the ratchet 64 in the clockwise direction also causes motor member 66 and thus main motor shaft 30 to rotate in the clockwise direction. Thus during the run mode (as in the rewind mode), the clockwise rotation of the main motor shaft 30 causes the inner end of the spring 34 to wind in the clockwise direction.

As illustrated as a preferred example, the first spring gear 44 has 52 teeth (designated by the expression 52T in FIG. 1*a*), and the first pinion gear 52 has 16 teeth producing a gear ratio of 3.25:1 (52÷16). The rewind gear 58 has 56 teeth and the second pinion gear 54 has 12 teeth, producing a gear ratio of 4.67:1 (56÷12). Therefore, for each turn of the spring drum 38 the rear wheel axle 50 rotates 3.25 times. However, it requires 4.67 rotations of that same rear wheel axle 50 to drive the rewind gear 58 and, therefore, the main motor shaft 30 through one complete rotation. Thus, as the rear wheel axle 50 rotates 3.25 times, the main motor shaft 30 rotates about 69.6% ((52/16)÷(56/12)) of one revolution thus producing a net unwinding of the spring 34 of about 30.4% of a revolution for every revolution of spring drum 38 or for every 3.25 revolutions of the rear wheel axle 50. Stating it another way, the rear wheels 20 of the car rotate about 10.7 (3.25÷0.304) times for each full turn of unwinding of the spring 34. While the stated ratios are presently preferred, it will be apparent that the present invention is not intended to be limited to such gears and gear ratios, and other values may be selected, as will be apparent to the person of ordinary skill in the art.

As previously noted, the motor 10 is in rewind mode only when the rear wheels 20 are caused to rotate in the clockwise direction (the backward direction). Hence, if for example a child playing with a toy vehicle incorporating the motor 10 reciprocates the car in both the forward and backward directions as an attempt to rewind the motor, there will be some loss of the winding effort each time the car goes in the forward direction. There is approximately a 10 to 1 ratio between the winding and the unwinding of the motor 10; hence, each reciprocatory cycle will be approximately 90% efficient in winding up the motor (as compared to only rearward movement). The loss of approximately 10% efficiency is of no practical significance. Of course, as a practical matter, any person using a toy car incorporating the motor 10 will not know these details and will in no way be conscious of the fact that there is any loss whatsoever in a reciprocatory rewinding operation. As a pragmatic fact, when a person playing with a toy incorporating a motor such as that described herein goes through the rewinding operation, that operation is produced very quickly by forward and backward movement of the car and, upon completion, the car is ready for operation again.

CONCLUSION

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements that perform substantially the same function in substantially the same way to achieve the same results are within the scope of the invention. Moreover, it should be recognized that structures or elements shown or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spring motor operable in a run mode and in a rewind mode, the spring motor comprising:

a first spring gear;

a second spring gear being on a same axis as the first spring gear;

a spring having a first end and a second end, the first end of the spring being yieldably engaged to the first spring gear and the second end of the spring being connected to the second spring gear;

a rewind gear being on the same axis as the first spring gear and the second spring gear;

a first drive pinion being in mesh with the first spring gear;

a second drive pinion being in mesh with the second spring gear;

a rear wheel axle parallel to the axis shared by the first spring gear, the second spring gear, and the rewind gear, the rear wheel axle having the first and second drive pinions thereon;

a fixed gear that is at all times in mesh with the rewind gear;

means responsive to rotation of the second drive pinion when the spring motor is in the run mode for engaging the rewind gear with the second spring gear, the means for engaging comprising ratchet means connected to the rewind gear and operatively engaged with the second spring gear, the ratchet means causing the second spring gear to rotate in a direction opposite to the rotation of the first spring gear during the rewind mode of the spring motor; and means for blocking the unwinding of the spring when the spring motor is in the rewind mode, the means for blocking comprising a floating gear that is at all times in mesh with the second spring gear;

wherein the fixed gear is in mesh with the floating gear during the rewind mode, and wherein the fixed gear is not in mesh with the floating gear during the run mode.

2. The spring motor of claim 1, wherein the spring is a spiral spring with the first end being the outer end of the spiral and the second end being the inner end.

3. The spring motor of claim 1 wherein the means for blocking further comprises a retainer having a detent, wherein the detent maintains enmeshment of the floating gear with the fixed gear during the rewind mode of the spring motor, and wherein the detent maintains disenmeshment of the floating gear and the fixed gear during the run mode of the spring motor.

4. The spring motor of claim 3 wherein the retainer is made of plastic.

5. The spring motor of claim 3 wherein the retainer is made of elastic metal.

6. A toy vehicle comprising:

a chassis;

a motor frame mounted in the chassis;

a spring motor mounted in the motor frame, the spring motor being operable in a run mode and a rewind mode, the spring motor comprising:

a first spring gear;

a second spring gear being on a same axis as the first spring gear;

a spiral spring having a first end and a second end, the first end of the spring being yieldably engaged to the first spring gear and the second end of the spring being connected to the second spring gear;

a rewind gear being on the same axis as the first spring gear and the second spring gear;

a first drive pinion being in mesh with the first spring gear;

a second drive pinion being in mesh with the second spring gear;

a rear wheel axle parallel to the axis shared by the first spring gear, the second spring gear, and the rewind gear, the rear wheel axle having the first and second drive pinions thereon;

a fixed gear that is at all times in mesh with the rewind gear;

means responsive to rotation of the second drive pinion when the spring motor is in the run mode for engaging the rewind gear with the second spring gear, the means for engaging comprising ratchet means connected to the rewind gear and operatively engaged with the second spring, the ratchet means causing the second spring gear to rotate in a direction opposite to the rotation of the first spring gear during the rewind mode of the spring motor; and means for blocking the unwinding of the spring when the spring motor is in the rewind mode, the means for blocking comprising a floating gear that is at all times in mesh with the second spring gear;

wherein the fixed gear is in mesh with the floating gear during the rewind mode, and wherein the fixed gear is not in mesh with the floating gear during the run mode.

7. The toy vehicle of claim 6 wherein the means for blocking further comprises a retainer having a detent, wherein the detent maintains enmeshment of the floating gear with the fixed gear during the rewind mode of the spring motor, and wherein the detent maintains disenmeshment of the floating gear and the fixed gear during the run mode of the spring motor.

8. The toy vehicle of claim 7 wherein the retainer is made of plastic.

9. The toy vehicle of claim 7 wherein the retainer is made of elastic metal.

* * * * *